US006843709B1

(12) United States Patent
Crkvenac et al.

(10) Patent No.: US 6,843,709 B1
(45) Date of Patent: Jan. 18, 2005

(54) CHEMICAL MECHANICAL POLISHING METHOD FOR REDUCING SLURRY REFLUX

(75) Inventors: T. Todd Crkvenac, Hockessin, DE (US); Jeffrey J. Hendron, Elkton, MD (US); Gregory P. Muldowney, Glen Mills, PA (US)

(73) Assignee: Rohm and Haas Electronic Materials CMP Holdings, Inc., Wilmington, DE (US)

( * ) Notice: Subject to any disclaimer, the term of this patent is extended or adjusted under 35 U.S.C. 154(b) by 0 days.

(21) Appl. No.: 10/734,945

(22) Filed: Dec. 11, 2003

(51) Int. Cl.[7] ..... B24B 1/00

(52) U.S. Cl. ..... 451/41; 451/5; 451/6; 451/285; 451/287

(58) Field of Search ..... 457/41, 5, 10, 457/285, 60, 287; 438/697, 693; 216/88, 89; 252/79.4; 156/345.13; 106/3

(56) References Cited

U.S. PATENT DOCUMENTS 5,020,283 A 6/1991 Tuttle
5,486,129 A * 1/1996 Sandhu et al. ..... 451/5
5,645,469 A 7/1997 Burke et al.
5,674,109 A * 10/1997 Kanzawa et al. ..... 451/41
5,921,855 A 7/1999 Osterheld et al.
5,990,012 A 11/1999 Robinson et al.
6,159,088 A 12/2000 Nakajima
6,273,806 B1 8/2001 Bennett et al.
6,354,919 B2 3/2002 Chopra
6,520,847 B2 2/2003 Osterheld et al.
6,602,436 B2 8/2003 Mandigo et al.
6,652,354 B2 * 11/2003 Hayashi et al. ..... 451/5

* cited by examiner

*Primary Examiner*—George Nguyen
(74) *Attorney, Agent, or Firm*—Blake T. Biederman

(57) ABSTRACT

A method of polishing a surface (120) of an article, e.g., a semiconductor wafer (112, 212), using a polishing layer (108, 208) in the presence of a polishing medium, such as a slurry (116). The method includes selecting the rotational rate of the article or the velocity of the polishing layer, or both, so as to control either removal rate uniformity or the occurrence of defects on the polished surface, or both.

10 Claims, 3 Drawing Sheets

CHEMICAL MECHANICAL POLISHING METHOD FOR REDUCING SLURRY REFLUX

BACKGROUND OF THE INVENTION

The present invention generally relates to the field of chemical mechanical polishing. More particularly, the present invention is directed to a chemical mechanical polishing method for reducing slurry reflux.

In the fabrication of integrated circuits and other electronic devices, multiple layers of conducting, semiconducting and dielectric materials are deposited onto and etched from a surface of a semiconductor wafer. Thin layers of conducting, semiconducting and dielectric materials may be deposited by a number of deposition techniques. Common deposition techniques in modern wafer processing include physical vapor deposition (PVD), also known as sputtering, chemical vapor deposition (CVD), plasma-enhanced chemical vapor deposition (PECVD) and electrochemical plating. Common etching techniques include wet and dry isotropic and anisotropic etching, among others.

As layers of materials are sequentially deposited and etched, the uppermost surface of the wafer becomes non-planar. Because subsequent semiconductor processing (e.g., photolithography) requires the wafer to have a flat surface, the wafer needs to be planarized. Planarization is useful for removing undesired surface topography and surface defects, such as rough surfaces, agglomerated materials, crystal lattice damage, scratches and contaminated layers or materials.

Chemical mechanical planarization, or chemical mechanical polishing (CMP), is a common technique used to planarize workpieces, such as semiconductor wafers. In conventional CMP utilizing a dual-axis rotary polisher, a wafer carrier, or polishing head, is mounted on a carrier assembly. The polishing head holds the wafer and positions the wafer in contact with a polishing layer of a polishing pad within the CMP polisher. The polishing pad has a diameter greater than twice the diameter of the wafer being planarized. During polishing, each of the polishing pad and wafer is rotated about its concentric center while the wafer is engaged with the polishing layer. The rotational axis of the wafer is offset relative to the rotational axis of the polishing pad by a distance greater than the radius of the wafer such that the rotation of the pad sweeps out a ring-shaped "wafer track" on the polishing layer of the pad. The width of the wafer track is equal to the diameter of the wafer when the only movement of the wafer is rotational. However, in some dual-axis CMP polishers, the wafer is also oscillated in a plane perpendicular to its rotational axis. In this case, the width of the wafer track is wider than the diameter of the wafer by an amount that accounts for the displacement due to the oscillation. The carrier assembly provides a controllable pressure between the wafer and polishing pad. During polishing, a slurry, or other polishing medium, is flowed onto the polishing layer and into the gap between the wafer and polishing layer. The wafer surface is polished and made planar by chemical and mechanical action of the polishing layer and slurry on the surface.

The interaction among polishing layers, polishing slurries and wafer surfaces during CMP is being increasingly studied in an effort to optimize polishing pad designs. Most of the polishing pad developments over the years have been empirical in nature. In addition, much of the design of polishing layers has focused primarily on providing these layers with various patterns and configurations of voids and grooves that are claimed to enhance slurry utilization and polishing uniformity. Over the years, quite a few different groove and void patterns and configurations have been implemented. Prior art groove patterns include radial, concentric circular, Cartesian grid and spiral, among others. Prior art groove configurations include configurations wherein the depth of all the grooves are uniform among all grooves and configurations wherein the depth of the grooves varies from one groove to another.

Some CMP pad designers have considered the effect of the rotation of the polishing pad on polish uniformity, e.g., observing that regions of the wafer more distal from the rotational axis of the polishing pad are swept by a greater area of the polishing surface. For example, in U.S. Pat. No. 5,020,283 to Tuttle, Tuttle discloses that in order to achieve a uniform removal rate relative to the distance from a polished region of the wafer to the rotational axis of the polishing pad, it is desirable to increase the void ratio within the polishing layer with increasing radial distance from the axis of pad rotation. In addition to considering the effect of pad rotation on the polish uniformity, it is generally recognized that in the context of dual-axis CMP polishers, described generally above, that if no polishing slurry were present, optimal polish uniformity is achieved when the rotational speeds of the pad and wafer are equal to each other (i.e., synchronous). However, it has been observed that once polishing slurry is introduced into a synchronous dual-axis polisher, polishing uniformity often becomes diminished.

Although the rotation of the polishing pad has been considered in designing prior art CMP processes and the benefits of synchronous rotation in the absence of polishing slurry are known, it appears that the effects of relative rotational speeds of the polishing pad and wafer in the presence of polishing slurry have not been fully considered in optimizing CMP using dual-axis polishers. In addition, similar principles do not appear to have been considered in connection with other types of polishers, such as belt-type polishers. Accordingly, there is a need for a CMP method that optimizes polishing uniformity based upon the relative speeds of the polishing pad and wafer. There is also a need for a CMP method that reduces the defectivity, i.e., the occurrence of defects such as macro-scratches, of the polished surface.

SUMMARY OF THE INVENTION

In a first aspect of the present invention, a method of polishing a surface of an article using a polishing layer and a polishing medium, the method comprising the steps of: (a) providing the polishing medium so that the polishing medium is present between the surface of the article and the polishing layer, (b) rotating the article so that the surface rotates at a first rotational rate about a first rotational axis; (c) moving the polishing layer at a velocity relative to the first rotational axis; and (d) selecting at least one of the first rotational rate and the velocity of the polishing layer such that backmixing does not occur within the polishing medium between the surface and the polishing layer when the surface is rotated at the first rotational rate and the polishing layer is moved at the velocity.

In a second aspect of the present invention, a method of polishing a surface of an article using a polishing layer while rotating the article about a first rotational axis at a first rotational rate and moving the polishing layer relative to the first rotational axis at a velocity, the method comprising the steps of: (a) selecting one of a backmixing mode for self-sustaining chemistries and a non-backmixing mode for non-self-sustaining chemistries; and (b) selecting at least one of the first rotational rate of the article and the velocity of the polishing layer based upon the one of the backmixing mode and the non-backmixing mode selected in step (a).

DETAILED DESCRIPTION OF THE INVENTION

Figure 1:
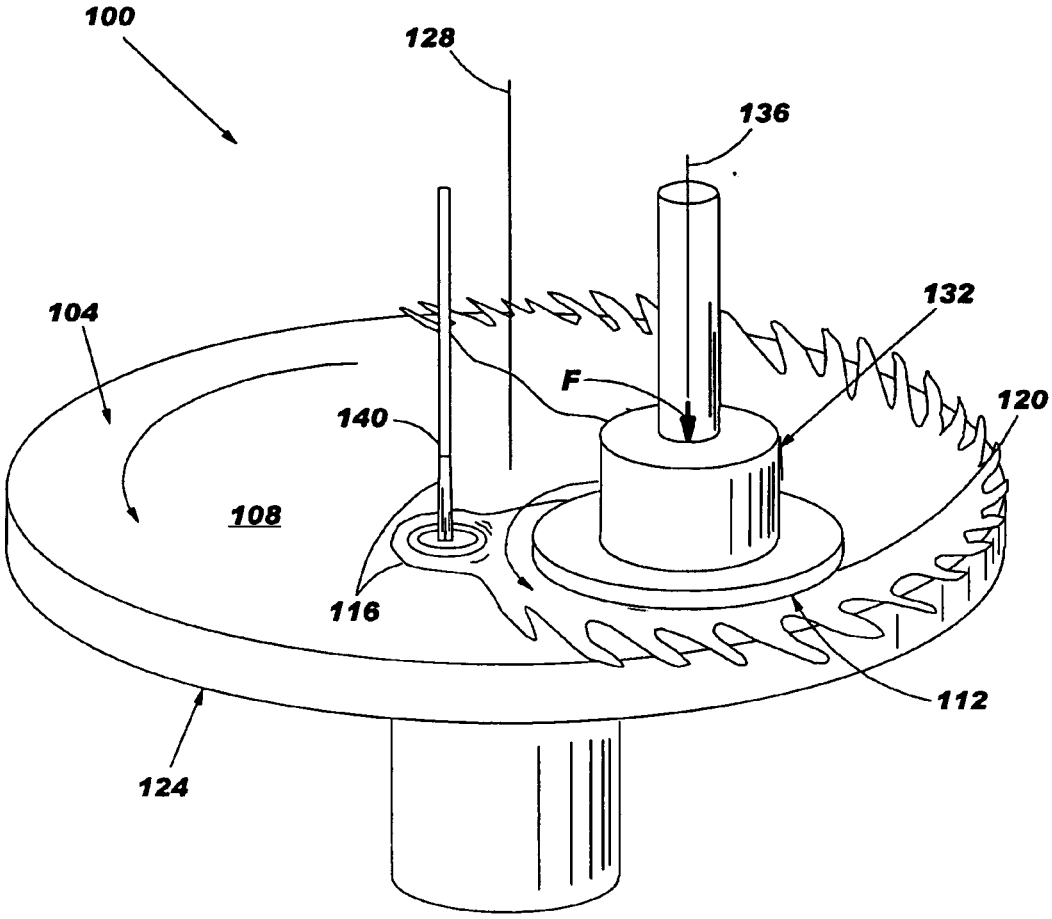
FIG. 1 is a perspective view of a portion of a dual-axis polisher suitable for use with the present invention.

Referring now to the drawings, FIG. 1 shows a dual-axis chemical mechanical polishing (CMP) polisher 100 suitable for use with the present invention. Polisher 100 includes a polishing pad 104 having a polishing layer 108 operatively configured to engage an article, such as semiconductor wafer 112 (processed or unprocessed) or other workpiece, e.g., glass, flat panel display and magnetic information storage disk, among others, so as to effect polishing of the polished surface of the wafer in the presence of a slurry 116 or other liquid polishing medium. For the sake of convenience, the terms "wafer" and "slurry" are used in the below description without the loss of generality. In addition, for the purpose of this specification, including the claims, the terms "polishing medium" and "slurry" do not exclude abrasive-free and reactive-liquid polishing solutions. As discussed below in detail, the present invention includes a method of selecting the rotational rates of polishing pad 104 and wafer 112 so as to control the occurrence and extent of "backmixing" present in slurry 116 in the region between the pad and wafer where the rotational direction of the wafer is generally opposite the rotational direction of the polishing pad.

Backmixing is generally defined as a condition that occurs within slurry 116 between polishing pad 104 and wafer 112 when the velocity, or component thereof, of the slurry anywhere between the pad and wafer, or within any grooves or texturing present on the surface of the pad, is opposite the tangential velocity of the polishing pad. Slurry 116 on polishing layer 108 outside the influence of wafer 112 generally rotates at the same, or very similar, speed as polishing pad 104 at steady state. However, when slurry 116 contacts polished surface 120 of wafer 112, adhesive, frictional and other forces due to the interaction of the slurry and the polished surface will cause the slurry to accelerate in the direction of rotation of the wafer. Of course, the acceleration will be most dramatic at the interface between slurry 116 and polished surface 120 of wafer 112, with the acceleration diminishing with increasing depth within the slurry from the polished surface. The rate of diminishment of the acceleration will depend upon various properties of slurry, such as dynamic viscosity. This phenomenon is an established aspect of fluid mechanics referred to as a "boundary layer."

Polisher 100 may include a platen 124 on which polishing pad 104 is mounted. Platen 124 is rotatable about a rotational axis 128 by a platen driver (not shown). Wafer 112 may be supported by a wafer carrier 132 that is rotatable about a rotational axis 136 parallel to, and spaced from, rotational axis 128 of platen 124. Wafer carrier 132 may feature a gimbaled linkage (not shown) that allows wafer 112 to assume an aspect very slightly non-parallel to polishing layer 108, in which case rotational axes 128 and 136 may be very slightly askew. Wafer 112 includes polished surface 120 that faces polishing layer 108 and is planarized during polishing. Wafer carrier 132 may be supported by a carrier support assembly (not shown) adapted to rotate wafer 112 and provide a downward force F to press polished surface 120 against polishing layer 108 so that a desired pressure exists between the polished surface and polishing layer during polishing. Polisher 100 may also include a slurry inlet 140 for supplying slurry 116 to polishing layer 108.

As those skilled in the art will appreciate, polisher 100 may include other components (not shown) such as a system controller, slurry storage and dispensing system, heating system, rinsing system and various controls for controlling various aspects of the polishing process, such as: (1) speed controllers and selectors for one or both of the rotational rates of wafer 112 and polishing pad 104; (2) controllers and selectors for varying the rate and location of delivery of slurry 116 to the polishing pad; (3) controllers and selectors for controlling the magnitude of force F applied between the wafer and pad, and (4) controllers, actuators and selectors for controlling the location of rotational axis 136 of the wafer relative to rotational axis 128 of the pad, among others. Those skilled in the art will understand how these components are constructed and implemented such that a detailed explanation of them is not necessary for those skilled in the art to understand and practice the present invention.

During polishing, polishing pad 104 and wafer 112 are rotated about their respective rotational axes 128, 136 and slurry 116 is dispensed from slurry inlet 140 onto the rotating polishing pad. Slurry 116 spreads out over polishing layer 108, including the gap beneath wafer 112 and polishing pad 104. Polishing pad 104 and wafer 112 are typically, but not necessarily, rotated at selected speeds between 0.1 rpm and 150 rpm. Force F is typically, but not necessarily, of a magnitude selected to induce a desired pressure of 0.1 psi to 15 psi (0.69 to 103 kPa) between wafer 112 and polishing pad 104.

Figure 2A:
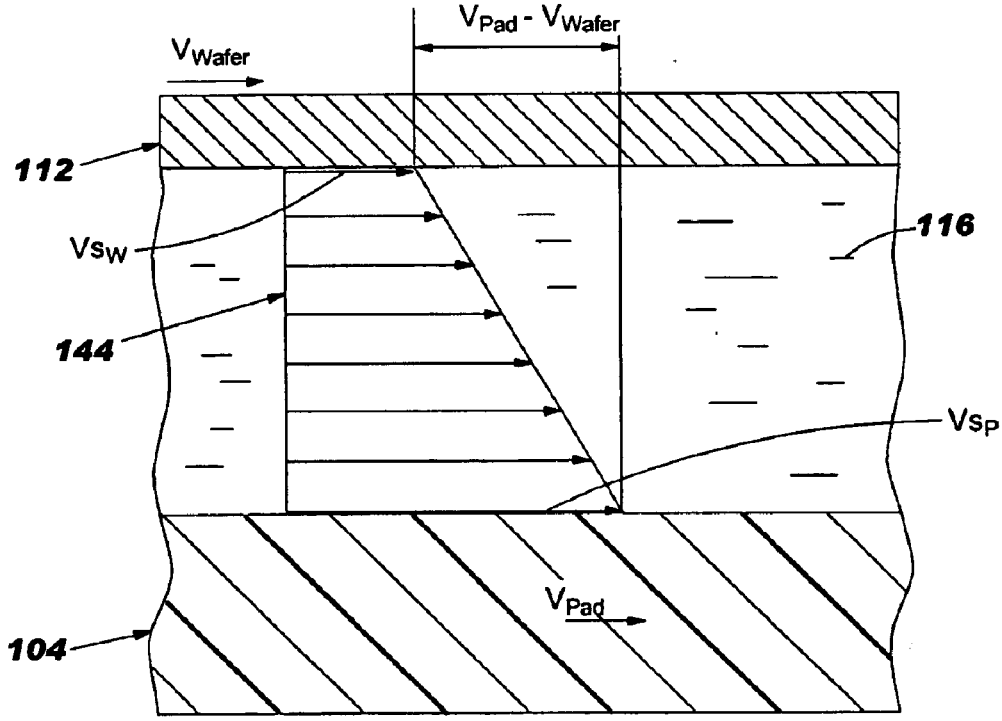
FIG. 2A is a cross-sectional view of the wafer and polishing pad of FIG. 1 illustrating a tangential velocity profile within a region of the slurry wherein backmixing is not present.

As mentioned above, the present invention includes a method of selecting the rotational rates of polishing pad 104 or wafer 112, or both, so as to control the occurrence and extent of backmixing that occurs within slurry 116 between the wafer and polishing pad, or within any grooves or texturing present on the surface of the polishing pad. FIG. 2A illustrates a velocity profile 144 of the tangential velocity, with respect to polishing pad 104, in slurry 116 between wafer 112 and the pad under conditions wherein backmixing is not present. The direction of rotation of wafer 112 depicted in velocity profile 144 is generally the same as the rotational direction of polishing pad 104, but the magnitude of the wafer velocity $V_{S_W}$ in slurry 116 proximate the wafer is lower than the tangential velocity $V_{S_P}$ in the slurry proximate the polishing pad. When steady state is reached, the difference in the velocities $V_{S_W}$ of slurry immediately adjacent wafer 112 and $V_{S_P}$ of slurry immediately adjacent polishing pad 104 is substantially equal to the tangential pad velocity $V_{pad}$ minus the tangential wafer velocity $V_{wafer}$ at the respective points of the wafer and polishing pad 104 under consideration.

Figure 2B:
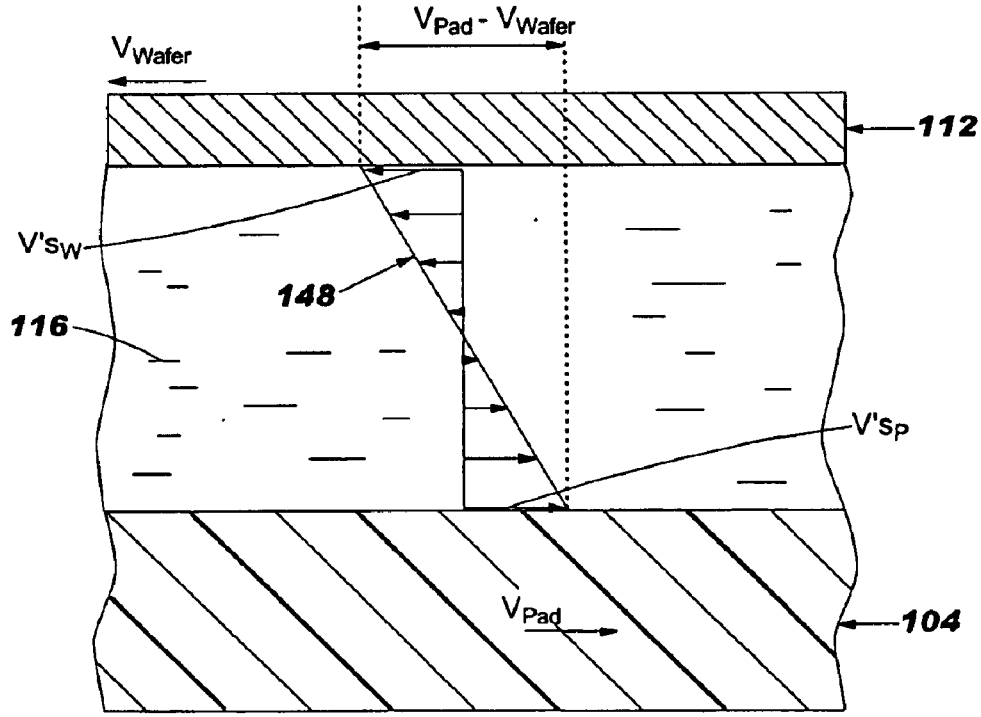
FIG. 2B is a cross-sectional view of the wafer and polishing pad of FIG. 1 illustrating a tangential velocity profile within a region of the slurry wherein backmixing is present.

FIG. 2B, on the other hand, illustrates a velocity profile 148 of the tangential velocity, again with respect to polishing pad 104, in slurry 116 between wafer 112 and the pad under conditions that create backmixing. Here, the tangential wafer velocity $V_{wafer}$ is in a direction opposite the tangential pad velocity $V_{pad}$ and has a magnitude greater than the magnitude of the tangential pad velocity $V_{pad}$. Accordingly, the difference $V_{pad}-V_{wafer}$ is negative, as indicated by the velocity $V'_{S_W}$ in slurry 116 adjacent wafer 112 being in a direction opposite the velocity $V'_{S_P}$ in the slurry adjacent polishing pad 104. When these velocities $V'_{S_W}$ and $V'_{S_P}$ are opposite one another, backmixing is said to be occurring, since the upper portion of slurry 116 is being driven "back" by wafer 112, i.e., at least partially in a direction opposite the direction of the movement of polishing pad 104 and the slurry proximate the pad.

Figure 3:
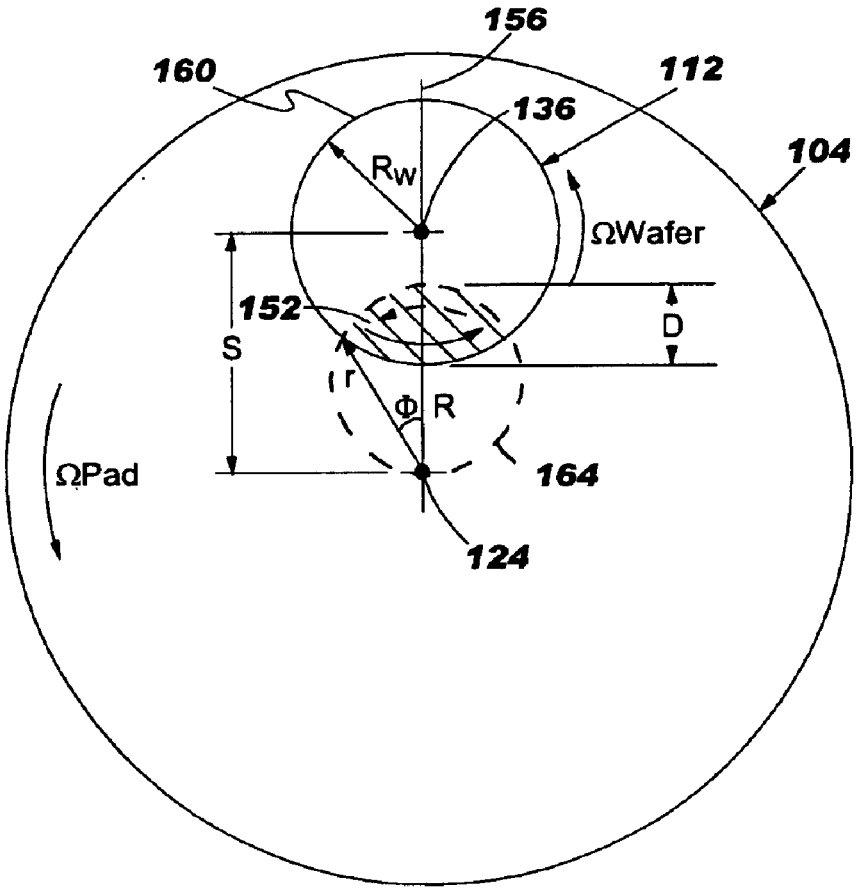
FIG. 3 is a plan view of the wafer and polishing pad of the polisher of FIG. 1 illustrating the presence of a slurry backmixing region between the wafer and polishing pad.

FIG. 3 illustrates variables that may be used to determine when backmixing is present in slurry 116 between wafer 112 and polishing pad 104 and, when present, to determine the extent of the resulting backmixing region 152. The extent of backmixing region 152 may be expressed as a distance D that the backmixing region extends beneath wafer 112 along a radial line 156 containing rotational axis 124 of polishing pad 104 and rotational axis 136 of the wafer as measured from the peripheral edge 160 of the wafer. It will be apparent to those skilled in the art that backmixing region 152, when present, is located at and inward from peripheral edge 160 of wafer 112 and is disposed symmetrically about line 156. This is so because the velocity vectors of wafer 112 and polishing pad 104 are parallel to each other only along line 156. At every point of wafer 112 other than points lying along line 156, the velocity vectors of the wafer thereat may be resolved into two components, one parallel to the tangential velocity vector of polishing pad 104 and one perpendicular to this tangential velocity vector, wherein the perpendicular component is always greater than zero. Those skilled in the art will also appreciate that backmixing region 152 cannot practically extend to or beyond rotational axis 136 of wafer 112 along line 156. This is so because the direction of the tangential component of any velocity vector of wafer 112 beyond rotational axis 136 along line 156 will never be opposite the direction of the tangential velocity vector of polishing pad 104. Therefore, distance D will be less than the radius $R_W$ of wafer 112.

Referring still to FIG. 3, it has been found that backmixing will not occur when:

$$\Omega_{wafer_{critical}} = \left[\frac{S - R_{wafer}}{R_{wafer}}\right]\Omega_{pad} \qquad \{1\}$$

wherein: $\Omega_{wafer_{critical}}$ is the critical rotational rate of wafer 112 below which backmixing will not occur; $\Omega_{pad}$ is the rotational rate of polishing pad 104; S is the distance of separation between rotational axis 136 of the wafer and rotational axis 124 of the pad; and $R_{wafer}$ is the radius of the polished surface 120 (see FIG. 1) of the wafer being polished. It is noted that separation distance S is substantially fixed on many conventional CMP polishers, although there is often a small side-to-side oscillation of wafer 112 typically amounting to less than a 10% variation in separation distance S. However, this is not to say that variability cannot be built into a polisher utilizing the present invention. Where such oscillation is present, the critical rotational rate of wafer 112 will oscillate accordingly between the values obtained from equation (1) using alternately the values of separation distance S at the two extremes of the oscillation. In addition, it is noted that while the polished surface of wafer 112, i.e., the article being polished, is shown as being circular and thus having a true radius, the surface being polished may be another shape, such as oval or polygonal, among others. In this case, such surface does not have a true radius, but may be considered to have an effective radius. Generally, the effective radius may be defined as the distance from the rotational axis of the surface of the article being polished to a point on this surface that is most distal from the rotational axis.

As discussed below, knowing critical rotational rate $\Omega_{wafer_{critical}}$ can be important in controlling removal rate uniformity and defectivity. In addition, when backmixing is present, distance D that backmixing region 152 extends along line 156 can be determined from the following equation:

$$D = R_{wafer} - \left(\frac{S}{1 + \frac{\Omega_{wafer}}{\Omega_{pad}}}\right) \qquad \{2\}$$

wherein: $\Omega_{wafer}$ is the rotational rate of wafer 112 and the remaining variables are the same as above relative to Equation {1}. Knowing the extent of backmixing region 152 as expressed by distance D can be useful for adjusting the size of the backmixing region, e.g., to optimize a CMP process wherein backmixing is desirable and to control the "edge effect" familiar to those skilled in CMP art. Further, backmixing region 152 may be approximated as a region generally circumscribed by the dashed circle 164 and peripheral edge 160 of wafer 112. The equation of dashed circle 164 is:

$$r(\sec\varphi) = \left(\frac{S}{1 + \frac{\Omega_{pad}}{\Omega_{wafer}}}\right) \qquad \{3\}$$

wherein the variables are as defined above in connection with Equations {1} and {2}.

Backmixing is relevant to polishing in the presence of slurry 116 because the removal rate of material from polished surface 120 (FIG. 1) of wafer 112 depends on, among other things, the concentration of active chemicals and polish byproducts within the slurry, and backmixing region 152, when present, has a different concentration of these materials than an un-backmixed region. By virtue of the reversal of the direction of the velocity in slurry 116 in a portion of the slurry within backmixing region 152, backmixing generally reduces the infusion of fresh slurry into the backmixing region and increases the residence time of spent slurry in this region. The difference in concentrations of active chemicals and byproducts between backmixing region 152 and the region beneath wafer 112 outside of the backmixing region causes the polishing rates, or rates of removal, to differ between these regions.

Those skilled in the art are familiar with the following "Preston equation" for calculating rates of removal of material from a surface being polished in the presence of a slurry.

$$\text{Removal Rate} = K_{chem}(K_{mech})P[V_{pad-wafer}] \qquad \{4\}$$

wherein: $K_{chem}$ is a constant relating to removal of material from the wafer by chemical action; $K_{mech}$ is a constant relating to removal of the wafer material by mechanical action; P is the pressure applied between the wafer and pad;

and $V_{pad-wafer}$ is the difference in velocity between the pad and wafer. When backmixing is present, the value of the chemical action constant $K_{chem}$ is different at locations between the pad and wafer where backmixing is present than at locations where no backmixing is present. As can be seen from the Preston equation, this difference leads to non-uniformity of removal rates. The value of the mechanical action constant $K_{mech}$ may also be different between back-mixed and un-backmixed regions if polish debris itself acts as an abrasive medium or if spent abrasive particles, when present, have substantially lower mechanical action than fresh particles.

For many polishing processes, such as CMP, utilizing slurry 116, the polish rate, or removal rate, will decrease in the presence of spent slurry, and polish byproducts, such as polish debris, may accumulate in backmixing region 152, increasing both the non-uniformity of polish and levels of defects such as scratches on polished surface 120 (FIG. 1).

On the other hand, some polishing processes, such as CMP of copper, proceed via kinetics that may be enhanced when a minimum concentration of polish byproducts is present to sustain some or all of the chemical reactions necessary for polishing to occur. For convenience, the type of polishing solutions, e.g., slurries, used for such processes are referred to herein and in the claims appended hereto as "self-sustaining" polishing media. In processes utilizing self-sustaining polishing media, the absence of backmixing will typically result in much lower removal rates. Nevertheless, in all CMP processes the risk of defectivity is typically higher when polish debris can be recaptured by the rotation of wafer 112, as occurs within backmixing region 152. Consequently, an advantage of flushing polish debris out from between wafer 112 and polishing pad 104 is that this flushing inhibits buildup of such debris on the pad and allows more stable removal rates across entire polished surface 120 (FIG. 1) of the wafer during a given period of polishing. Without effective removal of polish debris, the polish rate may vary from point to point on the polished surface and additionally may vary over time. Further, in any CMP process there is a generation of heat at the wafer surface due to friction and, to a lesser degree, chemical exotherm, which is conveyed away largely by the slurry flow between the wafer and pad. Heat removal by slurry flow is retarded within backmixing region 152 relative to areas lying outside this region, leading in general to a higher temperature in backmixing region 152 as compared to areas outside this region and correspondingly faster chemical reactions in backmixing region 152 that are an additional source of rate variations from point to point on the polished surface.

Consequently, regardless of which type of polishing process is used, substantial benefits may accrue from preventing backmixing. In other embodiments, it may be desirable to rotate each of wafer 112 and polishing pad 104 at respective rotational rates that cause the system to operate in either a "backmixing mode," wherein backmixing region 152 is present, or a "non-backmixing mode," wherein no backmixing occurs between the wafer and pad. For example, although defectivity may increase in the presence of polish debris, it may nevertheless be desirable to increase removal rates by performing a self-sustaining type polishing process in a backmixing mode. In this case, the rotational rate of wafer 112 or polishing pad 104, or both, may be selected so that the process is performed in a backmixing mode. Conversely, as discussed above, it may be desirable to perform a non-self-sustaining polishing process in a non-backmixing mode by appropriately selecting one, the other or both of the rotational rates of wafer 112 and polishing pad 104. Preferably, at least a portion of the polishing medium flows through grooves in the polishing layer such that backmixing does not occur in the grooves for the non-backmixing mode.

Still referring primarily to FIG. 3, depending upon the type of polisher used, e.g., polisher 100 of FIG. 1, the polisher may allow a user to adjust the rotational speeds of wafer 112 or polishing pad 104, or both, as well as allow the user to adjust separation distance S between rotational axes 136, 124 of the wafer and pad, respectively, among other things. Thus, a user may vary any one or more of these parameters so that the polisher operates in the desired one of backmixing mode and non-backmixing mode. For example, if the rotational rate $\Omega_{pad}$ of polishing pad 104 is fixed and the rotational rate $\Omega_{wafer}$ of wafer 112 is variable, the user may use Equation {1}, above, to determine the critical wafer rotational rate $\Omega_{wafer_{critical}}$ and then select a wafer rotational rate $\Omega_{wafer}$ above or below the critical wafer rotational rate $\Omega_{wafer_{critical}}$ to operate the polishing process in either a back-mixing mode or non-backmixing mode as desired. In addition, if the user desires to operate the polishing process in the backmixing mode and wants to control the extent of backmixing, for example to minimize the "edge effect" on a wafer, the user may solve Equation {2} iteratively using various wafer rotational rates $\Omega_{wafer}$ until a satisfactory distance D is achieved or, alternatively, solving Equation {2} for a wafer rotational rate $\Omega_{wafer}$ using a desired distance D. In any case, the user could then set the polisher to rotate wafer 112 at the resulting rotational rate $\Omega_{wafer}$.

Those skilled in the art will readily appreciate that Equations {1} and {2} can be similarly solved for a pad rotational rate $\Omega_{pad}$ when the wafer rotational rate $\Omega_{wafer}$ and the separation distance S are constant. Further, those skilled in the art will readily appreciate that these equations can likewise be solved for separation distance S when the pad and wafer rotational rates $\Omega_{pad}$, $\Omega_{wafer}$ are constant. Of course, two or more of the pad and wafer rotational rates $\Omega_{pad}$, $\Omega_{wafer}$ and separation distance S may be varied simultaneously so as to achieve the desired results.

Figure 4:
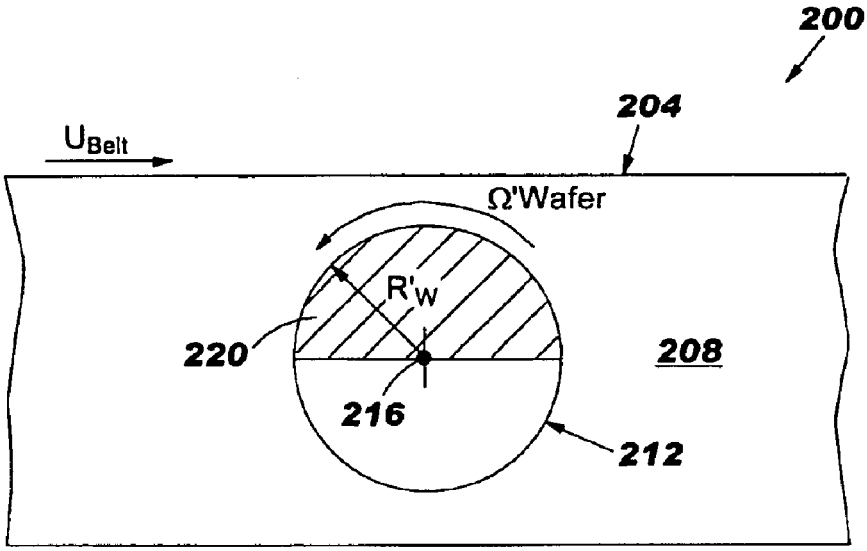
FIG. 4 is a plan view of a wafer and polishing belt of a belt-type polisher suitable for use with the present invention.

Although the present invention has been described above in the context of a dual-axis polisher 100 using a rotary polishing pad 104, those skilled in the art will understand that the present invention may be applied to other types of polishers, such as linear belt polishers. FIG. 4 shows a linear belt polisher 200 that includes a polishing belt 204 having a polishing layer 208 that is moved at a linear velocity $U_{belt}$ relative to wafer 212, or other article, that itself is rotated at a rotational rate $\Omega'_{wafer}$ about a rotational axis 216. During polishing, a slurry (not shown), or other polishing medium, is provided between wafer 212 and polishing belt 204, typically in the presence of pressure being applied to the wafer to press it against the belt. As can be readily envisioned, on one half 220 of wafer 212 the rotational velocity vectors thereon can be resolved into components that are opposite the direction of the belt velocity $U_{belt}$. Therefore, at least a portion of the slurry between this half 220 of wafer 212 and polishing belt 204 can be subjected to backmixing, depending on the magnitudes of the opposing velocities.

In this connection, backmixing of slurry will not occur when rotational speed $\Omega'_{wafer}$ of wafer 212 is less than or equal to a critical rotational speed $\Omega'_{wafer_{critical}}$ of the wafer, where:

$$\Omega'_{wafer_{critical}} = \frac{U_{belt}}{R'_{wafer}} \quad \{5\}$$

As with wafer radius $R_{wafer}$ discussed above in connection with dual-axis polisher 100 (FIGS. 1–3), if polished surface of wafer 212, or other article, is not circular, the value used for $R'_{wafer}$ may be an effective radius. Also similar to dual-axis polisher 100, above, the polishing belt velocity $U_{belt}$ or wafer rotational rate $\Omega'_{wafer}$, or both, may be varied so as to operate belt polisher 200 in either a backmixing mode or a non-backmixing mode. The reasons for selecting which operating mode is more desirable for a particular application are the same as discussed above in connection with dual-axis polisher 100.

What is claimed is:

1. A method of chemical mechanical polishing a surface of an article using a polishing layer and a polishing medium, the method comprising the steps of:

(a) determining a critical rotation rate of the article for backmixing of the polishing medium between the surface of the article and the polishing layer and providing the polishing medium so that the polishing medium is present between the surface of the article and the polishing layer;

(b) rotating the article so that the surface rotates at a first rotational rate about a first rotational axis;

(c) moving the polishing layer at a velocity relative to the first rotational axis; and (d) selecting at least one of the first rotational rate and the velocity of the polishing layer such that polishing occurs with the article rotating at a rate below the critical rotation rate when the surface is rotated at the first rotational rate and the polishing layer is moved at the velocity.

2. The method according to claim 1, wherein step (c) includes rotating the polishing layer about a second rotational axis.

3. The method according to claim 2, wherein the second rotational axis is spaced from the first rotational axis by a separation distance and step (d) includes determining at least one of the second rotational rate and the first rotational rate as a function of the separation distance.

4. The method according to claim 3, wherein the surface of the article has an effective radius and step (d) further includes determining at least one of the second rotational rate and the first rotational rate as a function of the effective radius.

5. The method of claim 1 wherein at least a portion of the polishing medium flows through grooves in the polishing layer such that backmixing does not occur in the grooves.

6. The method according to claim 1, wherein step (c) includes moving the polishing layer linearly at a linear velocity.

7. The method according to claim 6, wherein the surface of the article has an effective radius and step (d) includes determining at least one of the first rotational rate and the linear velocity as a function of the effective radius.

8. A method of chemical mechanical polishing a surface of an article using a polishing layer while rotating the article about a first rotational axis at a first rotational rate and moving the polishing layer relative to the first rotational axis at a velocity, the method comprising the steps of:

(a) selecting one of a backmixing mode for self-sustaining chemistries and a non-backmixing mode for non-self-sustaining chemistries; and (b) selecting at least one of the first rotational rate of the article and the velocity of the polishing layer based upon the one of the backmixing mode and the non-backmixing mode selected in step (a).

9. The method according to claim 8, wherein the polishing layer is rotated about a second rotational axis spaced from the first rotational axis by a separation distance and step (b) includes determining at least one of the second rotational rate and the first rotational rate as a function of the separation distance.

10. The method according to claim 8, wherein the method includes the non-backmixing mode to reduce defectivity.

* * * * *